US011189443B2

(12) United States Patent
Huang

(10) Patent No.: US 11,189,443 B2
(45) Date of Patent: Nov. 30, 2021

(54) ELASTIC BODY FOR KEYSWITCH ASSEMBLY AND KEYSWITCH ASSEMBLY

(71) Applicant: LITE-ON Technology (Chang Zhou) Co., LTD., Jiangsu Province (CN)

(72) Inventor: Bin Huang, Jiangsu Province (CN)

(73) Assignee: LITE-ON Technology (Chang Zhou) Co., LTD., Jiangsu Province (CN)

( * ) Notice: Subject to any disclaimer, the term of this patent is extended or adjusted under 35 U.S.C. 154(b) by 0 days.

(21) Appl. No.: 16/797,597

(22) Filed: Feb. 21, 2020

(65) Prior Publication Data

US 2020/0381196 A1 Dec. 3, 2020

(30) Foreign Application Priority Data

May 27, 2019 (CN) ..... 201910446464.8

(51) Int. Cl.
*H01H 13/14* (2006.01)
*H01H 13/52* (2006.01)
*H01H 13/88* (2006.01)

(52) U.S. Cl.
CPC ..... *H01H 13/14* (2013.01); *H01H 13/52* (2013.01); *H01H 13/88* (2013.01); *H01H 2221/044* (2013.01); *H01H 2229/044* (2013.01); *H01H 2229/062* (2013.01)

(58) Field of Classification Search
CPC ..... H01H 3/125; H01H 13/705; H01H 13/14; H01H 13/85; H01H 13/704; H01H 2233/07; H01H 2215/004; H01H 13/20; H01H 2227/026; H01H 13/52; H01H 13/702; H01H 3/12
See application file for complete search history.

(56) References Cited

U.S. PATENT DOCUMENTS

2020/0152401 A1* 5/2020 Huang ..... H01H 13/023
2020/0294738 A1* 9/2020 Wu ..... H01H 13/7065

FOREIGN PATENT DOCUMENTS

CN 2567660 Y 8/2003
CN 107481882 A 12/2017

* cited by examiner

*Primary Examiner* — Ahmed M Saeed
(74) *Attorney, Agent, or Firm* — Umberg Zipser LLP; Ryan Dean

(57) ABSTRACT

The present invention disclosed an elastic body for keyswitch assembly, comprising a body and identification marks. The body has an annular base and an elastic pressing part, and the elastic pressing part is disposed on the annular base. The identification marks are disposed on the side of the annular base. Therefore, the mold producing poor elastic body and cavities on it can be identified by the identification marks on the elastic body, so damaged cavities can be repaired quickly and effectively then. The location and means of marking of the identification marks does not affect the adhesion of the elastic body to the prefabricated thin film circuit board. The present invention further provides a keyswitch assembly comprising the elastic body of the present invention.

8 Claims, 4 Drawing Sheets

ELASTIC BODY FOR KEYSWITCH ASSEMBLY AND KEYSWITCH ASSEMBLY

CROSS REFERENCE TO RELATED APPLICATION

This application claims the priority benefit of Chinese Patent Application Ser. No. 201910446464.8, filed on May 27, 2019, the full disclosure of which is incorporated herein by reference.

BACKGROUND

Technical Field

The present invention relates to the technical field of keyswitch, particularly relates to an elastic body for keyswitch assembly and keyswitch assembly.

Related Art

At present, the keyswitch assembly of the computer keyboard is provided with an elastic body, and typically the elastic body is modeled by injection molding with molds and silicone materials. Generally, the manufacture of the elastic body requires a plurality of molds for injection molding, and each mold has a plurality of cavities so that several hundred or even thousands of elastic bodies are modeled in one injection. After each of the elastic bodies is punched out by the means of die, the elastic body is then adhered to the prefabricated thin film circuit board by a jig. However, in the above process of punching and adhering, the elastic bodies are randomly arranged. So, when there is any quality issue of the elastic body, it indicates that the cavity for the poorly molded elastic body is poorly designed or damaged. At present, the mold producing poor elastic body and cavities thereof is usually identified by the markings on the elastic body, so damaged cavities can be repaired quickly and effectively then. But the marking parts of the said elastic body is usually located on the upper surface of the base of the elastic body, and this kind of marking part makes the upper surface of the base of the elastic body uneven, resulting difficulties for the jig to adhere elastic bodies onto a prefabricated thin film circuit board.

SUMMARY

The embodiments of the present invention provide an elastic body for keyswitch assembly and a keyswitch assembly to solve the problems of difficulties for the current elastic body to adhere to the thin film circuit board.

In one embodiment of the present invention, an elastic body for keyswitch assembly is provided, which comprises a body and identification marks. The body has an annular base and an elastic pressing part, where the elastic pressing part is disposed on the annular base and the identification marks are marked on the side of the annular base.

In another embodiment of the present invention, a keyswitch assembly is provided, which comprises a baseplate, a thin film circuit board, a keycap, a supporting part and an elastic body as described in the first aspect. The thin film circuit board is disposed on the baseplate; the elastic body is disposed on the thin film circuit board; the keycap is disposed above the elastic body; the supporting part disposed between the baseplate and the keycap, wherein the upper end of the support part connects to the keycap and the lower end of the support part connects to the baseplate so that the keycap is possible to move up and down relative to the baseplate.

In the embodiments of the present invention, the position and arrangement of the identification marks on the elastic body do not affect the adhesion of the elastic body to the thin film circuit board. At the same time, the poor-quality cavities on the elastic body can be quickly positioned by the identification marks, so that the repair for the poor-quality mold can be quickly performed to improve the quality of the elastic body.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
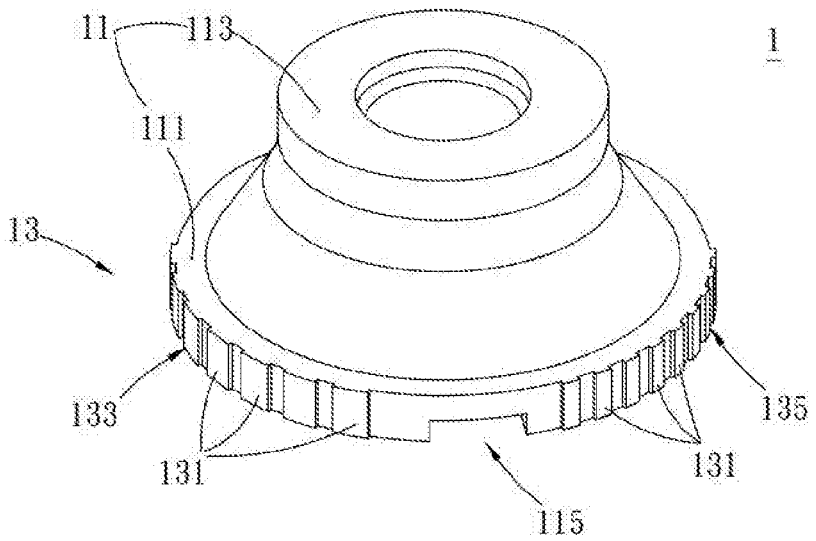
FIG. 1 is the perspective view of the elastic body for keyswitch assembly of the present invention.

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms “include/including” and “comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the invention.

Figure 2:
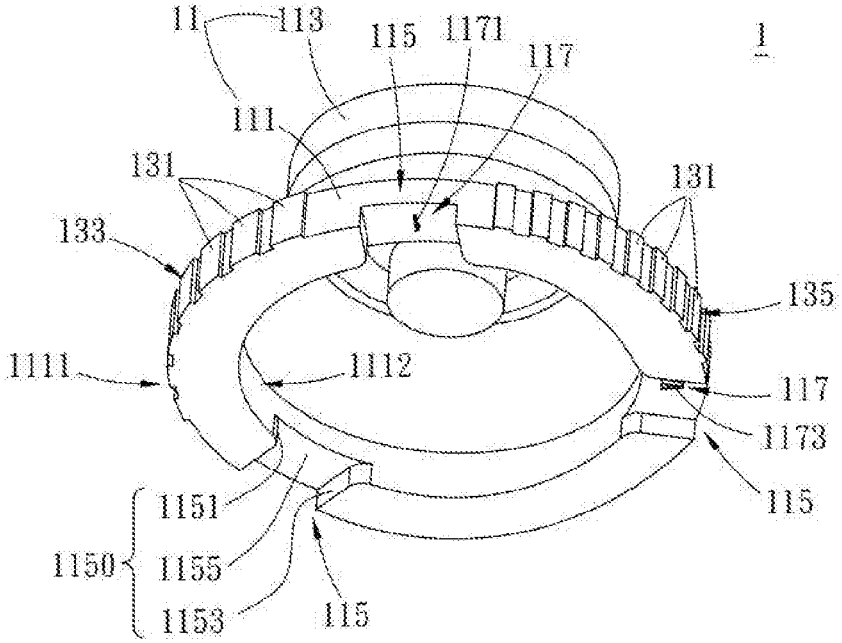
FIG. 2 is another perspective view of the elastic body for keyswitch assembly of the present invention.
Figure 3:
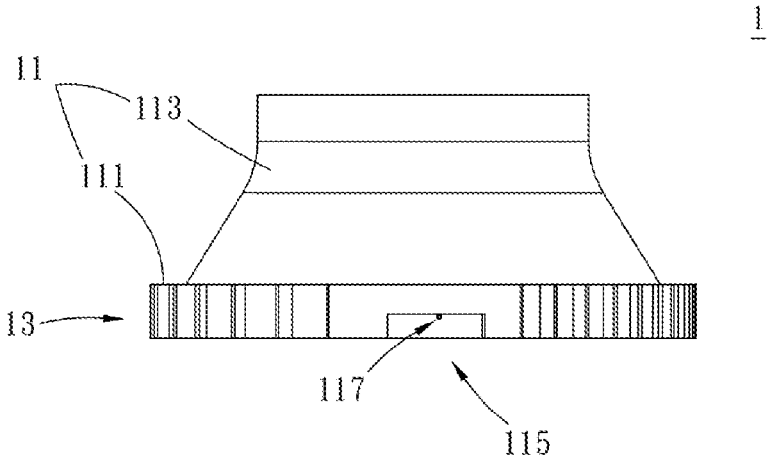
FIG. 3 is the side view of the elastic body for keyswitch assembly of the present invention.

Refer to FIG. 1 to FIG. 3, the perspective views and side view of the elastic body for keyswitch assembly of the present invention. An elastic body 1 is provided for keyswitch having a mark. The position of the mold for manufacturing the elastic body 1 and the cavity of the mold can be recognized by the corresponding mark on the elastic body 1. When an elastic body 1 is found damaged, it is possible to inspect the cavity of the mold for manufacturing the elastic body 1 according to the mark on the damaged elastic body 1, so that it is easy to repair the damaged cavity.

Refer to FIGS. 1 and 2, the elastic body 1 of the embodiment comprises a body 11 and an identification mark 13. The body 11 has an annular base 111 and an elastic pressing part 113. The elastic pressing portion 113 is disposed on the annular base 111. The annular base 111 has an outer side surface 1111 and an inner side surface 1112. In this embodiment, the identification mark 13 is disposed on the outer side surface 1111 of the annular base 111 and protrudes from the outer side surface 1111. However, the present invention is not limited thereto. In other embodiments, the identification mark 13 may also be disposed on the inner side surface 1112 of the annular base 111 and protrude from the inner side surface 1112. The identification mark 13 indicates the corresponding mold and the position of the cavity for the elastic body 1, and marking of the identification mark 13 can be adjusted according to the requirements of the user.

In the present embodiment, the identification mark 13 comprises at least one rib 131. Each rib 131 extends from the bottom of the outer side surface 1111 of the annular base 111 toward the elastic pressing part 113. That is, each rib 131 extends from one end far from the elastic pressing part 113 toward one end close to the elastic pressing part 113 on the side surfaces of the annular base 111. Moreover, the extending direction of each rib 131 can be parallel to the height direction of the annular base 111. The arrangement is advantageous for simplifying the manufacturing process of the rib 131, but the present invention is not going to limit this hereby. The extending direction of each rib 131 can also be inclined relative to the height direction of the annular base 111, which can be adjusted according to the requirements of the user. In addition, the cross-section area of each rib 131 orthogonal to the direction of the height of the annular base 111 can be semicircular, triangular or rectangular. In the present embodiment, the cross-section area of each rib 131 orthogonal to the direction of the height of the annular base 111 is rectangular.

In other embodiments, the elastic body 1 further comprises a plurality of air vents 115 disposed on the annular base 111. Each air vent 115 extends from the outer side surface 1111 of the annular base 111 to the inner side surface 1112 of the annular base 111. The inner surface 1150 of each air vent 115 is formed by the connection of a first sidewall 1151, a second sidewall 1153 and a connecting wall 1155, where the first sidewall 1151 is opposite to the second sidewall 1153, and the connecting wall 1155 connects the first sidewall 1151 and the second sidewall 1153. Three air vents 115 are shown in the present embodiment, however the number is not limited thereto, and it can be adjusted according to the requirements of the user.

Figure 4:
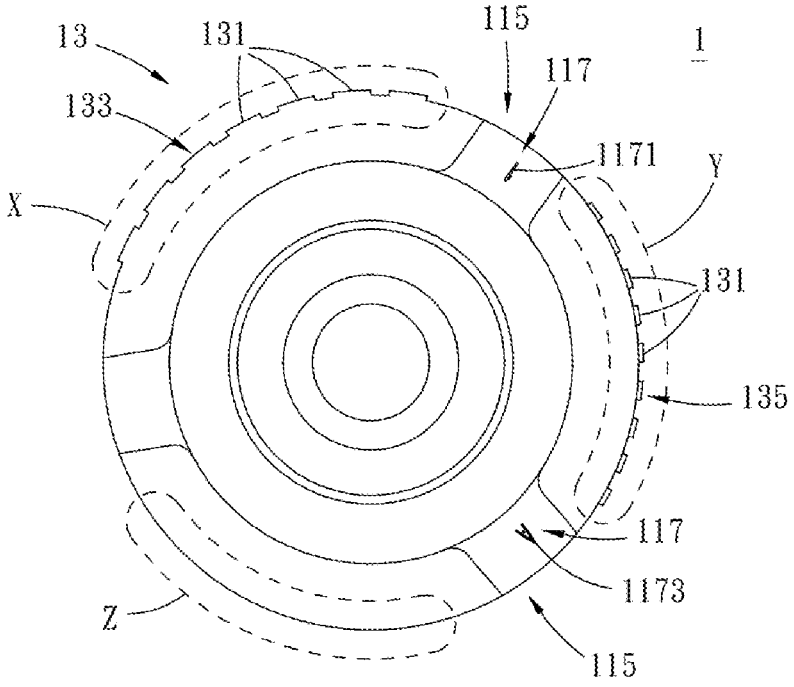
FIG. 4 is the bottom view of the first embodiment of the elastic body for keyswitch assembly of the present invention.

Refer to FIG. 4, which is a bottom view of the first embodiment of the elastic body for the keyswitch assembly of the present invention. In the present embodiment, the three air vents 115 divide the outer side surface 1111 of the annular base 111 into a first section X, a second section Y, and a third section Z as shown in the figure.

In one embodiment, the identification mark 13 comprises a first identification mark 133 and a second identification mark 135, where the first identification mark 133 is located in the first section X, the second identification mark 135 is located in the second section Y, and the first identification mark 133 and the second identification mark 135 are individually located between two corresponding adjacent air vents 115. That is, the first identification mark 133 is located between two adjacent air vents 115, and the second identification mark 135 is located between the other two adjacent air vents 115.

Furthermore, the configuration of the first identification mark 133 is different from that of the second identification mark 135, where the width of the rib 131 of the first identification mark 133 along the circumferential direction of the annular base 111 is different from the width of the rib 131 of the second identification mark 135 along the circumferential direction of the annular base 111. The first identification mark 133 represents which row the cavity is located on a mold, and the second identification mark 135 represents which column the cavity is located on a mold. Taking FIG. 4 as an example, the first identification mark 133 has seven thick ribs 131, and the second identification mark 135 has nine thin ribs 131, indicating that the cavity for the elastic body 1 is located at the ninth column of the seventh row on the mold. The above method is helpful for identifying the position of the cavity on a mold.

In one embodiment, the elastic body 1 further comprises identification characters 117. The identification characters 117 are disposed on the inner surface 1150 of the air vents 115, such as one of the first sidewall 1151, the second sidewall 1153 and the connecting wall 1155 of the air vents 115, or a combination thereof. In the present embodiment, the identification characters 117 is disposed on the connecting wall 1155 of the air vent 115. The identification characters 117 comprise a first identification character 1171 and a second identification character 1173, where the first identification character 1171 and the second identification character 1173 are individually disposed in the different corresponding air vents 115. The first identification character 1171 represents the mold number, the second identification character 1173 represents the area that the cavity for the elastic body is located on a mold, and the identification characters 117 are letters, numbers or symbols. Taking FIG. 4 as an example, the first identification character 1171 is the number 1, and the second identification character 1173 is the letter A, indicating that the cavity for elastic body 1 is located on the mold No. 1, and is located in the area A of the mold. To further consider the information of the first identification mark 133 and the second identification mark 135, it is obvious that the cavity for the elastic body 1 is located at the ninth column of the seventh row in area A of mold No. 1. Thus, the mold and the cavity position for manufacturing the elastic body 1 can be clearly identified by the identification marks 13 or/and the identification characters 117.

Figure 5:
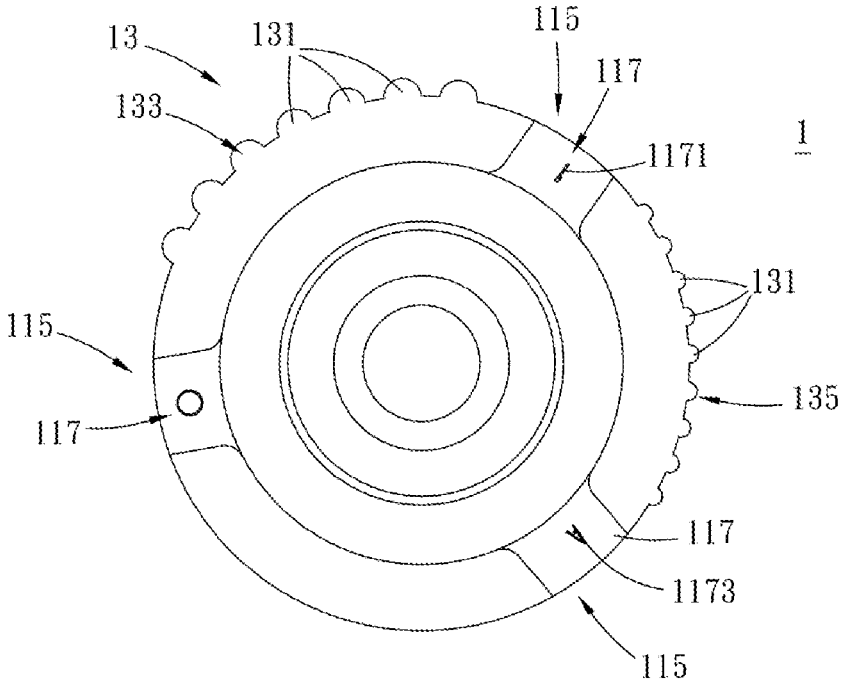
FIG. 5 is the bottom view of the second embodiment of the elastic body for keyswitch assembly of the present invention.

Refer to FIG. 5, which is a bottom view of the second embodiment of the elastic body for the key assembly of the present invention. As shown in the figure, the difference between the present embodiment and the first embodiment lies in the manner that the identification marks 13 and the identification characters 117 are marked. In the present embodiment, the cross-section area of each rib 131 of identification marks 13 orthogonal to the direction of the height of the annular base 111 is semicircular. In addition, circular identification characters 117 may be added to the unmarked air vents 115. The variations of the identification marks 13 and the identification characters 117 described above provide various marking combinations for the users to use.

Figure 6:
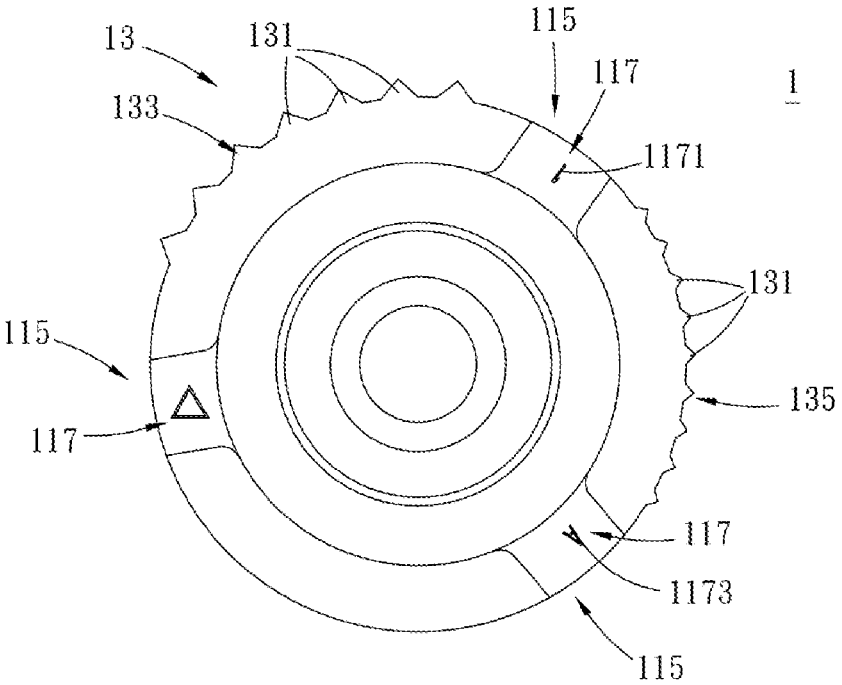
FIG. 6 is the bottom view of the third embodiment of the elastic body for keyswitch assembly of the present invention.

Refer to FIG. 6, which is a bottom view of the third embodiment of the elastic body for the keyswitch assembly of the present invention. As shown in the figure, the difference between the present embodiment and the first embodiment lies in the manner that the identification marks 13 and the identification characters 117 are marked. In the present embodiment, the cross-section area of each rib 131 of identification marks 13 orthogonal to the direction of the height of the annular base 111 is triangular. In addition, triangular identification characters 117 may be added to the unmarked air vents 115. The variations of the identification marks 13 and the identification characters 117 described above provide various marking combinations for the users to use. In the foregoing embodiments provided in FIG. 4 to FIG. 6 not limiting the present invention, the identification marks 13 and identification characters 117 can be used individually or in combination by the user, and the means of marking can be adjusted according to the requirements of the user.

Figure 7:
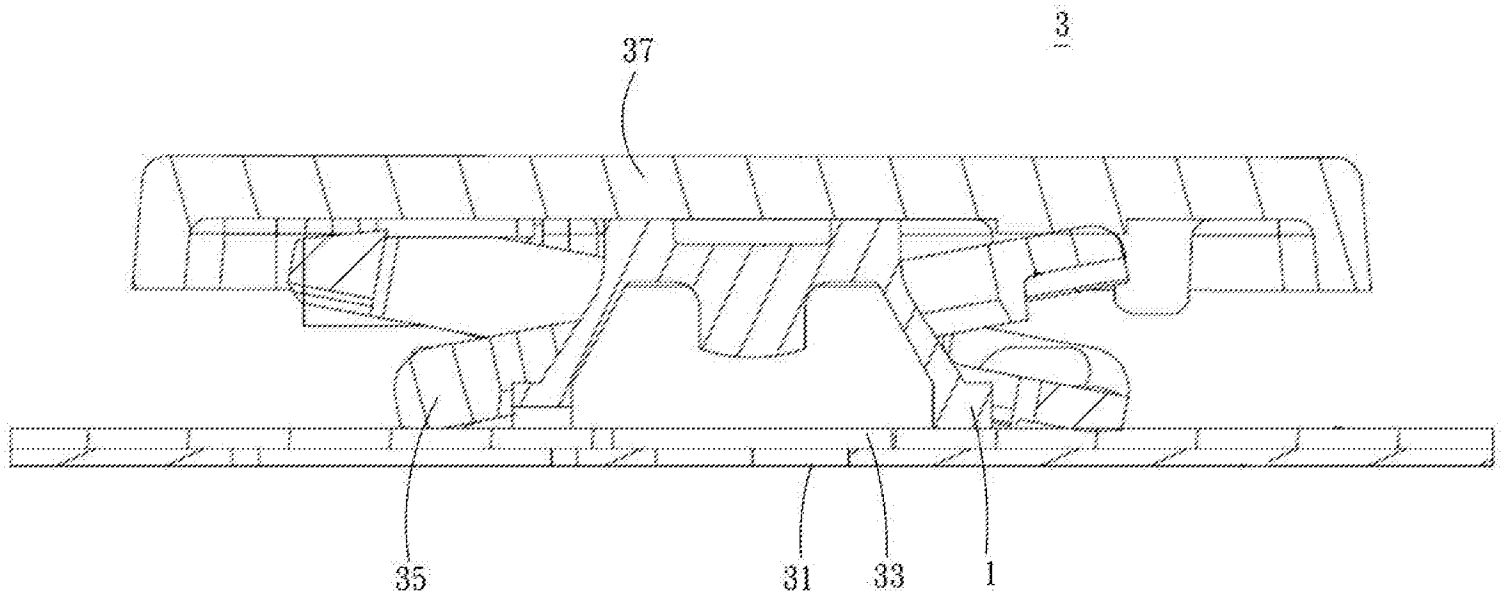
FIG. 7 is a schematic view of the keyswitch assembly of the present invention.

Refer to FIG. 7, which is a schematic view of the keyswitch assembly of the present invention. As shown in the figure, the present embodiment provides a keyswitch 3 comprising a baseplate 31, a thin film circuit board 33, a supporting part 35, a keycap 37, and an elastic body 1. The thin film circuit board 33 is disposed on the baseplate 31, the elastic body 1 is disposed on the thin film circuit board 33, and the keycap 37 is disposed above the elastic body 1. The supporting part 35 disposed between the baseplate 31 and the keycap 37, wherein the upper end of the support part 35 connects to the keycap 37 and the lower end of the support part 35 connects to the baseplate 31 so that the keycap 37 is possible to move up and down relative to the baseplate 31. When the keycap 37 is pressed, the elastic pressing part 113 of the elastic body 1 touch against the thin film circuit board 33 to electrically connect the circuit at the electrical connection point on the thin film circuit board 33; when the keycap 37 is released, the elastic pressing part 113 of the elastic body 1 detach from the thin film circuit board 33, and the electrical connection of the circuit at the electrical connection point on the thin film circuit board 33 is then opened.

In the other embodiment, keyswitch assemblies 3 are further assembled into a keyboard.

In summary, the present invention proposed an elastic body for keyswitch assembly and keyswitch assembly, where the identification marks of the elastic body disposed on the side of the annular base or/and the identification characters disposed in the air vents do not affect the bonding of jigs. That is, it does not affect the adhesion of the elastic body onto the prefabricated film circuit board by jigs. At the same time, the mold and the cavity for manufacturing the elastic body are easy to be identified by the marks or/and the characters mentioned above.

It is to be understood that the term "comprises", "comprising", or any other variants thereof, is intended to encompass a non-exclusive inclusion, such that a process, method, article, or device of a series of elements not only include those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. An elastic body for a keyswitch assembly, comprising:

an elastic body having an annular base and an elastic pressing part, wherein the elastic pressing part is disposed on the annular base;

identification marks disposed on an outer side surface or an inner side surface of the annular base and protruding from the outer side surface or the inner side surface; and a plurality of air vents disposed on the annular base, wherein each of the air vents extends from the outer side surface of the annular base to the inner side surface of the annular base;

wherein the identification marks comprise a first identification mark and a second identification mark, and the first identification mark and the second identification mark are individually located between two corresponding adjacent air vents.

2. The elastic body for a keyswitch assembly according to claim 1, wherein the identification marks comprise at least one rib, and each of the ribs extends from one end away from the elastic pressing part toward one end close to the elastic pressing part on the outer side surface or the inner side surface of the annular base.

3. The elastic body for a keyswitch assembly according to claim 2, wherein a cross-section area of each rib orthogonal to a direction of a height of the annular base is semicircular, triangular or rectangular.

4. The elastic body for a keyswitch assembly according to claim 1, wherein a width of a rib of the first identification mark along a circumferential direction of the annular base is different from a width of a rib of the second identification mark along the circumferential direction of the annular base.

5. An elastic body for a keyswitch assembly, comprising:

an elastic body having an annular base and an elastic pressing part, wherein the elastic pressing part is disposed on the annular base;

identification marks disposed on an outer side surface or an inner side surface of the annular base and protruding from the outer side surface or the inner side surface;

a plurality of air vents disposed on the annular base, wherein each of the air vents extends from the outer side surface of the annular base to the inner side surface of the annular base;

identification characters disposed on an inner surface of a groove of the air vents.

6. The elastic body for a keyswitch assembly according to claim 5, wherein the identification characters include a first identification character and a second identification character; the first identification character and the second identification character are individually disposed in the air vents corresponding thereto.

7. The elastic body for a keyswitch assembly according to claim 5, wherein the identification characters are letters, numbers or symbols.

8. A keyswitch assembly, comprising:

a baseplate;

a thin film circuit board disposed on the baseplate;

an elastic body disposed on the thin film circuit board;

a keycap disposed above the elastic body; and a supporting part disposed between the baseplate and the keycap, wherein an upper end of the support part connects to the keycap and a lower end of the support part connects to the baseplate so that the keycap is possible to move up and down relative to the baseplate;

wherein the elastic body comprises a body having an annular base and an elastic pressing part disposed on the annular base; identification marks disposed on an outer side surface or an inner side surface of the annular base and protruding from the outer side surface or the inner side surface; and a plurality of air vents disposed on the annular base, wherein each of the air vents extends from the outer side surface of the annular base to the inner side surface of the annular base;

wherein the identification marks comprise a first identification mark and a second identification mark, and the first identification mark and the second identification mark are individually located between two corresponding adjacent air vents.

* * * * *